US005576515A

United States Patent [19]

Bleich et al.

[11] Patent Number: 5,576,515

[45] Date of Patent: Nov. 19, 1996

[54] FIRE RESISTANT CABLE FOR USE IN LOCAL AREA NETWORKS

[75] Inventors: Larry L. Bleich, Omaha, Nebr.; Tommy G. Hardin, Lilburn, Ga.; William Meyers; Warren F. Moore, both of Omaha, Nebr.

[73] Assignee: Lucent Technologies Inc., Murray Hill, N.J.

[21] Appl. No.: 383,135

[22] Filed: Feb. 3, 1995

[51] Int. Cl.[6] ..... H01B 3/24; H01B 3/28

[52] U.S. Cl. ..... 174/110 PM; 174/110 FC; 174/113 R; 174/121 A

[58] Field of Search ..... 174/34, 110 FC, 174/110 PM, 113 R, 107, 121 A, 36, 102 R

[56] References Cited

U.S. PATENT DOCUMENTS

| | | | |
|---|---|---|---|
| 3,601,524 | 8/1971 | Kauffman | 174/74 R X |
| 3,748,372 | 7/1973 | McMahon et al. | 174/102 R |
| 4,284,842 | 8/1981 | Arroyo et al. | 174/107 |
| 4,605,818 | 8/1986 | Arroyo et al. | 174/107 |
| 4,963,609 | 10/1990 | Anderson et al. | 524/413 X |
| 5,074,640 | 12/1991 | Hardin et al. | 385/109 X |
| 5,162,609 | 11/1992 | Adriaenssens et al. | 174/34 |
| 5,253,317 | 10/1993 | Allen et al. | 385/109 X |
| 5,317,061 | 5/1994 | Chu et al. | 525/200 X |
| 5,378,539 | 1/1995 | Chen | 428/378 X |
| 5,399,434 | 3/1995 | Katz et al. | 428/421 X |
| 5,399,813 | 3/1995 | McNeil et al. | 174/117 |

OTHER PUBLICATIONS

Standard for Test Method for Fire and Smoke Characteristics of Electrical and Optical–Fiber Cables Used in Air Handling Spaces; American National Standard ANSI/UL 910–1990 (Mar. 4, 1985), pp. 1–14.

*Primary Examiner*—Kristine L. Kincaid
*Assistant Examiner*—Chau N. Nguyen

[57] ABSTRACT

A low pair count high performance, TIA/EIA 568 Category 5 plenum rated cable has a core made up of a plurality of twisted pairs of conductors, each conductor being insulated with a tetrafluoroethylene/hexafluoropropylene copolymer material, and a single twisted pair of conductors wherein each conductor is insulated with a high density polyethylene material. The core is surrounded and enclosed in a jacket of a plasticized copolymer of ethylene and clorotriflouroethylene material.

6 Claims, 1 Drawing Sheet

FIRE RESISTANT CABLE FOR USE IN LOCAL AREA NETWORKS

FIELD OF INVENTION

This invention relates to telecommunications cable having flame and smoke retardant characteristics and, more particularly, to a Category 5 plenum cable ideally suited for use in building interiors.

BACKGROUND OF THE INVENTION

In many buildings, most particularly office buildings, the room ceiling on each floor is usually spaced below the structural floor panel of the next higher floor and is referred to as a drop ceiling. This spacing creates a return air plenum for the building's heating and cooling systems, which is usually continuous throughout the entire length and breadth of the floor.

If a fire occurs within a room or rooms on a floor and below the drop ceiling, it may be contained by the walls, ceiling, and floor of the room. On the other hand, if the fire reaches the plenum it can spread at an alarming rate, especially, if, as is often the case, flammable materials are located within the plenum. Inasmuch as the plenum is a convenient place to route wires and cables, both electrical power and communication types, unless these wires and cables are flame and smoke retardant they can contribute to the rapid spread of fire and smoke throughout the floor and, worse, throughout the building.

As a result of the potential danger presented by flammable insulation of wires and cables, the National Electric Code (NEC) prohibits the use of electrical cables in plenums unless they are enclosed in metal conduits. Such metal conduits are difficult to route in plenums congested with other items or apparatus, and where, for example, it is desirable or necessary to rearrange the office and its communications equipment, computers, and the like, the re-routing of the conduits can become prohibitively expensive. As a consequence, the NEC permits certain exceptions to the conduit requirement. Where, for example, a cable is both flame resistant and low smoke producing, the conduit requirement is waived provided that the cable, in tests, meets or exceeds the code's requirement for flame retardation and smoke suppression. Such tests must be conducted by a competent authority such as the Underwriters Laboratory.

In the prior art, data and other signal transmission has been carried out on cables in which the conductors are insulated with, for example, polyvinyl chloride (PVC). However, such cables too often result in transmission losses which are undesirably high for the transmission of high frequency signals. As a consequence, various alternative cable structures, using various types of materials, have been tried. A plenum cable having superior resistance to flame spread and smoke evolution is shown in U.S. Pat. No. 4,284,842 of Arroyo et al, which incorporates a metallic barrier sheath system which reflects radiant heat. For smaller size plenum cables, i.e., fewer than twenty-five pairs of conductors, such a structure is unduly expensive. In U.S. Pat. No. 5,162,609 of Adriaenssens et al there is shown a fire resistant cable in which the individual wires of the core have a dual insulation system comprising an inner layer of suitable plastic material and an outer layer of a flame retardant plastic material. The insulation system has the desirable characteristics of low dissipation factor and low dielectric constant, and the jacket which surrounds the core, which comprises flame retardant polyolefin material, also has low dissipation factor and dielectric constant. The dual insulation arrangement, however, represents an additional cost increment, especially for low pair cables, and can, in some cases, lead to increased structural return loss (SRL).

Certain standards have been established for cables used in buildings, such as the Commercial Building Telecommunications Cabling Standard TIA/EIA-568, in which cables are classified and categorized as to their electrical characteristics. Of the various categories, Category 5 is the highest rating and indicates a cable having stringent required maxima and/or minima for parameters of D.C. resistance, pair-to-ground capacitance, impedance, structural return loss (SRL), attenuation, and near end cross-talk. A Category 5 cable must meet or exceed these requirements and is the preferred cable in those applications where data transmission at high frequencies is necessary, which applies to most modem day office systems. In order for a Category 5 cable to be used as a plenum cable, it must meet the NEC requirements for flame and smoke retardation, i.e., it must pass the burn tests as used by, for example, the Underwriters Laboratory. Thus a Category 5 low pair count plenum cable must meet the standards for Category 5 and, also, the standards for flame and smoke retardation for plenum cables in which case it is a UL CMP plenum rated cable.

At the present time, almost all of the low pair, i.e., six or fewer, typically four twisted pairs, Category 5 cables that are commercially available use a tetra-flouoro ethylene/hexafluro propylene copolymer (FEP) as insulation for the individual wires forming the pairs, and a jacket of fluoropolymer material such as a copolymer of ethylene and chlorotrifluoroethylene (ECTFE). The FEP material most commonly used is Teflon® TE-4100, manufactured by DuPont, and an ECTFE material commonly used for the jacket is Halar® 985, supplied by Ausimont, U.S.A. When such materials are used in a low-pair cable it meets the performance requirements for Category 5 cable, provided that it has the required fire and smoke retardation for meeting the requirements for use as a plenum cable.

FEP materials, such as Teflon®, are quite expensive and, at times, in limited or short supply, thereby making production of Category 5 plenum cable both expensive and limited as to quantity. In addition, Halar® 985, although excellent as to burn and smoke performance, is relatively stiff and often kinks, thereby making the cable somewhat difficult to route through any plenum and difficult to pull, and, the cable also is likely to be damaged when kinked.

SUMMARY OF THE INVENTION

The present invention is a TIA/EIA 568 Category 5 four pair UL CMP plenum rated cable which overcomes at least some of the aforementioned problems typical of prior art cables.

The cable of the invention comprises a plurality, e.g. four, twisted pairs of insulated conductors each of which comprises an elongated conductor member encased in insulation which has a low dissipation factor, typically less than 0.001 at 1 MHz, and an excellent dielectric constant, which is less than 2.5 at 1 MHz. Three of the twisted pairs are insulated with a fluorinated ethylene-propylene copolymer (FEP) material such as, for example, Teflon® and one of the twisted pairs is insulated with a high density polyethylene (HDPE) material. Both the FEP material and the HDPE material have the low dissipation factor and low dielectric constant mentioned heretofore, which insures optimum electrical performance, especially at high frequencies. In addition, both materials present a smooth surface of substantially uniform thickness, approximately six (6) to ten (10) mils, thereby insuring a low structural return loss (SPL).

As has been pointed out hereinbefore, FEP materials have excellent flame retardance as well as low smoke evolution characteristics. On the other hand, HDPE is quite flammable. To assure that the cable of the invention meets the NEC burn and smoke standards for plenum cable, the four twisted pairs are enclosed in a jacket comprised of a plasticized copolymer of ethylene and chlorotrifluoroethylene material having a thickness of from ten (10) to sixteen (16) mils. Such a material, an example of which is commercially available as Halar® 379, has a somewhat poorer burn performance than material without the plasticizer such as Halar® 985. However, the cable of the invention, as just described, with a 10 to 16 mil thick jacket, passes the UL 910 plenum burn test, thus the cable satisfies the requirements for a TIA/EIA 568 Category 5 UL CMP plenum rated cable, which all else being equal, is somewhat more economical to produce, but mainly decreases dependence on sometimes difficult to obtain materials, because of the elimination of Teflon® as insulation for one of the twisted pairs.

It is to be understood that thicknesses stated for the insulation and the jacket are approximations, being subject to the normal manufacturing variations, but within the normal manufacturing tolerances.

The cable is also physically easier to handle and route through a plenum because of the flexibility imparted thereto by the plasticizer in the jacket material. In addition, there is a reduced tendency to kink which, as pointed out in the foregoing, is one of the problems encountered with prior an cable.

These and other features and advantages of the invention will be more readily apparent from the following derailed description read in conjunction with the accompanying drawings.

DETAILED DESCRIPTION

Figure 1:
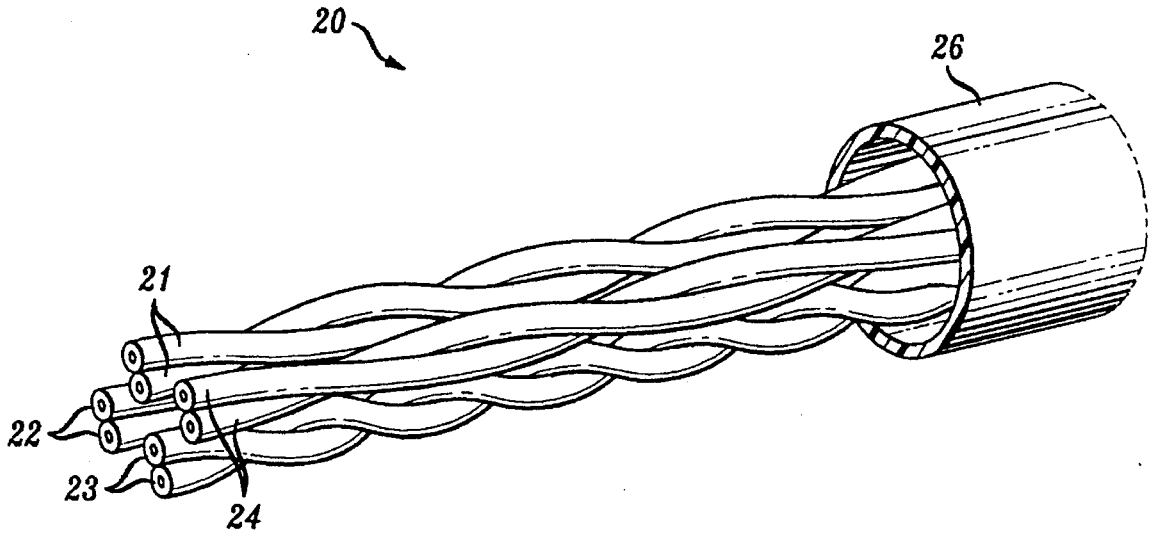
FIG. 1 is a perspective view of the cable of the invention.
Figure 2:
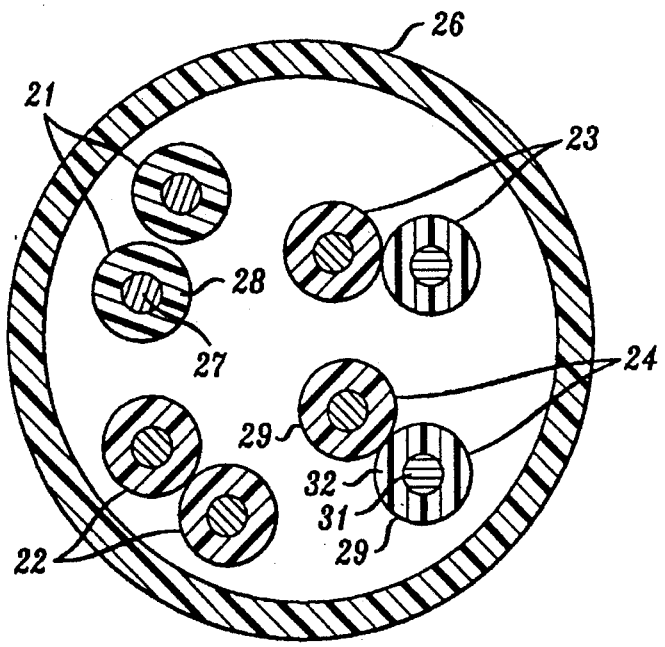
FIG. 2 is a cross-sectional view of the cable of FIG. 1.

In FIG. 1 there is shown a perspective view of a four-pair Category 5 plenum cable 20 embodying the principles of the present invention. The four sets of twisted pairs comprise three pairs 21, 22 and 23 and a fourth pair 24, forming a cable core which is surrounded by a protective and insulating jacket 26. As better seen in FIG. 2, which is a cross-sectional view of the cable 20 of FIG. 1, each of the wires forming each of the twisted pairs 21, 22, and 23 comprise a metallic, preferably copper, conducting portion 27 encased in an insulating portion 28, approximately 6 to 10 mils thick, formed of an FEP material such as Teflon® TE-4100 having a low dissipation factor of approximately 0.001 or less at 1 MHz, and a low dielectric constant of approximately 1.9 or less at 1 MHz. In order for a non-shielded cable such as is shown in FIGS. 1 and 2 to be capable of transmitting high frequency signals such as are encountered in the typical modem computer equipped office environment, a dissipation factor of 0.004 or less is desirable. Additionally, for low loss transmission of high frequency data signals, it is desirable that the insulation be characterized by a suitably low dielectric constant, i.e., less than 2.5 at 1 MHz. It can been seen that the twisted pairs 21, 22 and 23 all have insulation portions 28,28 whose dissipation factor and dielectric constant are considerably lower than the stated upper limits.

The fourth twisted pair 24 comprises two insulated conductors 29,29, each of which constitutes a metallic, preferably copper, conducting portion 31 encased in an insulating portion 32, approximately 8 mils thick, for example, of a high density polyethylene material (HDPE). Like the FEP material of pairs 21, 22 and 23, HDPE has a dissipation factor of approximately 0.001 or less at 1 MHz and a dielectric constant of approximately 2.3 or less at 1 MHz. Thus, the electrical performance of twisted pair 24 is comparable to that of pairs 21, 22 and 23, and meets the requirements for a Category 5 cable core.

The use of HDPE for the insulation 32 of twisted pair 24 results in possibly a small savings in cable cost, inasmuch as HDPE costs approximately a factor of about seventeen less than Teflon®. More important, however is the fact that HDPE is readily available whereas Teflon® is often difficult to obtain, especially in the quantities necessary for the production of large amounts of cable. In addition, HDPE has a much lower specific gravity than Teflon®, approximately 0.94–0.95 to Teflon's 2.1, which is also desirable.

However, HDPE exhibits very poor flame retardance and smoke suppression, hence, it is necessary, where the cable is to be used as a plenum cable, that the jacket 26 have sufficient flame retardance and smoke suppression characteristics sufficient to prevent the HDPE material from igniting. In accordance with the present invention, the jacket 26 which surrounds the cable core formed by the twisted pairs comprises a flouropolymer material, more specifically a copolymer of ethylene and chlorotrifluoroethylene (ECTFE) and plasticizer material, such as, the example, Halar® 379. The thickness of the jacket 26 is approximately 15 mils, for example, so that there will be sufficient flame retardation and smoke suppression without the sacrifice of the flexibility produced by combining the plasticizer with the ECTFE material. The thickness of the jacket is in the 10 to 16 mil range, 15 mils having been found to be excellent as to performance.

In order for an unshielded cable to qualify as a plenum cable, it must be subjected to the Underwriters Laboratory Plenum Burn Test, UL 910, in which cable samples of a length of approximately twenty-four feet are arrayed on a cable tray within a fire-test chamber, with a total cable width of several samples being approximately twelve inches. A 300,000 BTU/hour flame with a 240 feet per minute air flow within the chamber is applied to and engulfs the first four and one-half feet of the cable, and the flame is applied for twenty minutes. In order for the cable to pass the burn test and qualify as a plenum cable, the flame cannot spread beyond an additional five feet.

The exit end of the chamber is fitted to a rectangular-to-round transition piece and a straight horizontal length of vent pipe. A light source is mounted along the horizontal vent pipe at a point approximately sixteen feet from the vent end of the transition section and the light beam therefrom is directed upwardly and across the interior of the vent pipe. A photoelectric cell is mounted opposite the light source to define a light path length transversely through the vent pipe of approximately thirty-six inches, of which approximately sixteen inches are taken up by the smoke in the vent pipe. The output of the cell is directly proportional to the amount of light received from the light source, and provides a measure of light attenuation within the vent resulting from smoke, particulate matter, and other effluents. The output of the photoelectric cell is connected to a suitable recording device which provides a continuous record of smoke obscuration as expressed by a dimensionless parameter, optical density, given by the equation:

$$\text{Optical Density} = \log_{10}\frac{Ti}{T} \quad (1)$$

where Ti is the initial light transmission through a smokeless vent pipe, and T is the light transmission in the presence of smoke in the vent pipe. The maximum optical density permissible is 0.5, and the average optical density cannot exceed 0.15.

The cable of the present invention, when tested in accordance with the foregoing had, in a first test, a maximum flame propagation of approximately 1.0 feet, a peak optical density of 0.46, and an average optical density of 0.11. In a second test, the maximum flame propagation of the samples was 1.5 feet, the peak optical density was 0.37, and the average optical density was 0.12. Thus, it can be seen that the samples of the cable of the invention passed both the burn and smoke phases of the UL 910 Burn Test, thereby qualifying as an unshielded plenum cable.

From the foregoing, it can be seen that the cable of the invention qualifies as a TIA/EIA 568 Category 5 UL CMP plenum rated cable that is more readily available than such cables currently in use today, being somewhat less dependent upon the availability of certain of the materials presently used in such cables. Additionally, the cable is more flexible than other presently used cables, thereby making routing thereof considerably easier. Various changes to or modifications of the cable may occur to workers in the an without departure from the spirit and scope of the invention.

We claim:

1. An unshielded fire-retardant cable suitable for the transmission of high frequency signals, said cable comprising:

a core comprising a plurality of twisted pairs of insulated conductors, each of said insulated conductors of each of said twisted pairs comprising an elongated metallic conducting member encased in an insulation layer of a tetrafluoroethylene/hexafluoropropylene copolymer having a dissipation factor less than 0.001 at 1 MHz and a dielectric constant less than 2.5 at 1 MHz, and at least one twisted pair of insulated conductors wherein each insulated conductor of said at least one twisted pairs comprises an elongated metallic conducting member encased in a layer consisting essentially of a high density polyethylene material having a dissipation factor of 0.001 or less at 1 MHz and a dielectric constant less than 2.5 at 1 MHz; and a jacket member surrounding said core, said jacket member comprising a plasticized fire retardant material.

2. An unshielded fire-retardant cable as claimed in claim 1 wherein said plasticized fire-retardant jacket material is a plasticized copolymer of ethylene and chlorotrifluoroethylene.

3. An unshielded fire-retardant cable as claimed in claim 1 wherein said insulation layer of each of said conductors in said plurality of twisted pairs is from six (6) to ten (10) mils thick.

4. An unshielded fire-retardant cable as claimed in claim 1 wherein each of said layers of high density polyethylene is from six (6) to ten (10) mils thick.

5. An unshielded fire retardant cable as claimed in claim 1 wherein said jacket member is approximately ten (10) to sixteen (16) mils thick.

6. An unshielded fire resistant cable for the transmission of high frequency signals and suitable for use within building plenums comprising:

a core comprising three twisted pairs of insulated conductors, each of said conductors comprising an elongated metallic conducting member encased in a six (6) to ten (10) mil thick layer of a tetrafluoroethylene/hexafluoropropylene copolymer material having a dissipation factor less than 0.001 at 1 MHz and a dielectric constant less than 2.5 at 1 MHz;

said core further comprising a fourth twisted pair of insulated conductors, each of said conductors comprising an elongated metallic conducting member encased in a six (6) to ten (10) mil thick layer of high density polyethylene material having a dissipation factor of approximately 0.001 or less at 1 MHz and a dielectric constant of 2.5 or less at 1 MHz; and a jacket member surrounding said core, said jacket member being approximately ten (10) to sixteen (16) mils thick and comprising a plasticized copolymer of ethylene and chlorotrifluoroethylene material.

* * * * *